US010087879B2

(12) United States Patent
Haefner et al.

(10) Patent No.: US 10,087,879 B2
(45) Date of Patent: Oct. 2, 2018

(54) CYLINDER HEAD DEVICE FOR AN INTERNAL COMBUSTION ENGINE AND INTERNAL COMBUSTION ENGINE HAVING SUCH A CYLINDER HEAD DEVICE

(71) Applicant: Daimler AG, Stuttgart (DE)

(72) Inventors: Jochen Haefner, Lorch (DE); Cecile Jecker, Esslingen (DE)

(73) Assignee: Daimler AG, Stuttgart (DE)

( * ) Notice: Subject to any disclaimer, the term of this patent is extended or adjusted under 35 U.S.C. 154(b) by 96 days.

(21) Appl. No.: 14/433,462

(22) PCT Filed: Sep. 26, 2013

(86) PCT No.: PCT/EP2013/002891

§ 371 (c)(1),
(2) Date: Apr. 3, 2015

(87) PCT Pub. No.: WO2014/056578

PCT Pub. Date: Apr. 17, 2014

(65) Prior Publication Data

US 2015/0260122 A1 Sep. 17, 2015

(30) Foreign Application Priority Data

Oct. 12, 2012 (DE) ..... 10 2012 020 030

(51) Int. Cl.
*F02F 1/36* (2006.01)
*F01L 1/24* (2006.01)
(Continued)

(52) U.S. Cl.
CPC ..... *F02F 1/38* (2013.01); *F01L 1/047* (2013.01); *F01L 1/24* (2013.01); *F01L 1/3442* (2013.01);
(Continued)

(58) Field of Classification Search
CPC ... F02F 1/38; F01L 1/047; F01L 1/053; F01L 2001/0537; F01M 1/06; F01M 9/10;
(Continued)

(56) References Cited

U.S. PATENT DOCUMENTS 4,329,949 A * 5/1982 Abts ..... F01L 1/053 123/196 V
4,621,597 A * 11/1986 Kawada ..... F01L 1/04 123/193.5
(Continued)

FOREIGN PATENT DOCUMENTS

CN 101815850 A 8/2010
DE 697 07 213 T2 7/2002
(Continued)

OTHER PUBLICATIONS

Machine translation of DE102011109676A1, Haefner et al., Feb. 9, 2012, obtained from http://worldwide.espacenet.com/, pp. 1-6.*
(Continued)

*Primary Examiner* — Grant Moubry
(74) *Attorney, Agent, or Firm* — Crowell & Moring LLP

(57) ABSTRACT

A cylinder head device for an internal combustion engine includes a cylinder head having a first receiving region arranged on an inlet side of the cylinder head for at least one first camshaft to be mounted on the cylinder head, and at least one second receiving region arranged on an outlet side of the cylinder head which faces away from the inlet side for at least one second camshaft to be mounted on the cylinder head. The receiving regions are separated from one another at least in certain areas by an intermediate wall of the cylinder head which is arranged at least in certain areas between the receiving regions. A duct element, by means of which at least one element of the cylinder head device can be supplied with lubricant, runs in the intermediate wall.

8 Claims, 3 Drawing Sheets

Figure 1:
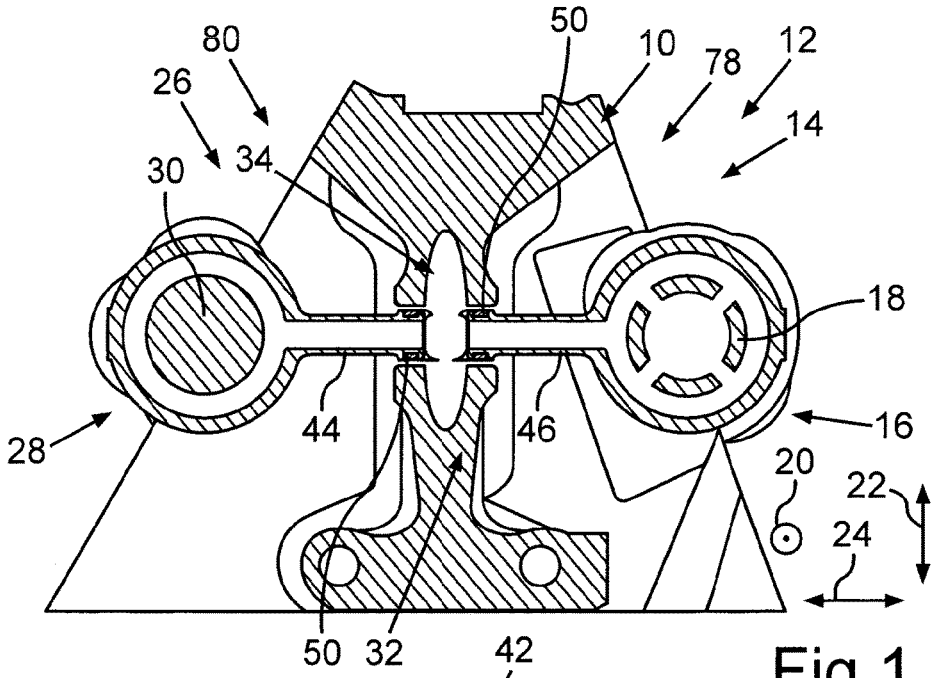

(51) Int. Cl.

| | |
|---|---|
| ***F02F 1/38*** | (2006.01) |
| ***F01L 1/047*** | (2006.01) |
| *F01L 1/053* | (2006.01) |
| *F01L 1/344* | (2006.01) |

(52) U.S. Cl.
CPC ..... *F01L 2001/0537* (2013.01); *F01L 2001/34423* (2013.01)

(58) Field of Classification Search
CPC ..... F01M 9/101; F01M 9/102; F01M 11/02; F01M 2001/064; F01M 2011/023
USPC ..... 123/90.33, 90.34, 90.38, 193.3, 193.5, 123/196 R
See application file for complete search history.

(56) References Cited

U.S. PATENT DOCUMENTS

| | | | | |
|---|---|---|---|---|
| 5,123,385 | A * | 6/1992 | Sado | F01L 1/02 123/193.5 |
| 5,816,205 | A | 10/1998 | Moriya | |
| 6,619,247 | B2 * | 9/2003 | Kobayashi | F01L 1/02 123/193.5 |
| 7,614,373 | B2 | 11/2009 | Shouji et al. | |
| 8,387,576 | B2 * | 3/2013 | Iwata | F01L 1/022 123/90.17 |
| 8,851,036 | B1 * | 10/2014 | Haefner | F02F 1/42 123/90.34 |
| 2002/0056426 | A1 | 5/2002 | Kobayashi | |
| 2008/0092843 | A1 * | 4/2008 | Yamada | F02F 1/40 123/193.5 |
| 2008/0135003 | A1 | 6/2008 | Lee | |

FOREIGN PATENT DOCUMENTS

| | | | |
|---|---|---|---|
| DE | 10 2007 002 430 | A1 | 6/2008 |
| DE | 10 2008 031 976 | A1 | 1/2010 |
| DE | 10 2009 020 100 | A1 | 11/2010 |
| DE | 10 2011 109 676 | A1 | 2/2012 |
| DE | 10 2011 012 149 | A1 | 9/2012 |
| EP | 1 134 402 | A2 | 9/2001 |
| FR | 2 663 983 | A1 | 1/1992 |
| JP | 59-30502 | U | 2/1984 |
| JP | 63-183407 | U | 11/1988 |
| JP | 10-30418 | A | 2/1998 |
| JP | 2000-73731 | A | 3/2000 |
| JP | 2007-132301 | A | 5/2007 |
| JP | 2009-13936 | A | 1/2009 |
| JP | 2009-174412 | A | 8/2009 |

OTHER PUBLICATIONS

International Search Report dated Mar. 5, 2014 with English translation (five (5) pages).
PCT Written Opinion (ISA/PCT/237) dated Mar. 5, 2014 (five (5) pages).
Japanese Office Action issued in Japanese counterpart application No. 2015-536008 dated Mar. 29, 2016, with partial English translation (Ten (10) pages).
Japanese Office Action issued in Japanese counterpart application No. 2015-536008 dated Oct. 25, 2016, with partial English translation (Five (5) pages).
Chinese Office Action issued in Chinese counterpart application No. 201380053011.X dated Oct. 10, 2016, with partial English translation (Thirteen (13) pages).

* cited by examiner

CYLINDER HEAD DEVICE FOR AN INTERNAL COMBUSTION ENGINE AND INTERNAL COMBUSTION ENGINE HAVING SUCH A CYLINDER HEAD DEVICE

BACKGROUND AND SUMMARY OF THE INVENTION

Exemplary embodiments of the invention relate to a cylinder head device for an internal combustion engine and to an internal combustion engine having such a cylinder head device.

Cylinder head devices of this kind for internal combustion engines have long been known from the general prior art. The cylinder head device comprises a cylinder head having at least one first receiving region arranged on an inlet side of the cylinder head for at least one first camshaft to be mounted on the cylinder head. Further, the cylinder head has at least one second receiving region arranged on an outlet side of the cylinder head facing away from the inlet side for at least one second camshaft to be mounted on the cylinder head. Here, the camshafts serve to actuate gas exchange valves that control the inflow and outflow of gas into and out of corresponding combustion chambers, in particular cylinders, of the internal combustion engine.

The cylinders are formed, for example, by a crankcase of the internal combustion engine, which is designed as a reciprocating piston internal combustion engine, wherein the cylinder head can be connected or is connected to the crankcase.

Such a cylinder head device can be found disclosed in German patent document DE 10 2009 020 100 A1. Its cylinder head has a sealing surface, by means of which the cylinder head can be connected to a cylinder head cover. Further, the cylinder head has in each case sealing flange surfaces, by means of which an exhaust gas module and an intake module can be connected to the cylinder head. At the same time, it is provided that the sealing surface is integrated into the respective sealing flange surface.

It has been shown that, with conventional cylinder head devices, the supply of at least one element with lubricant can only be implemented very laboriously. To feed the lubricant, in particular lubricating oil, to the appropriate element to be supplied with lubricant, elaborate piping and a multiplicity of duct elements can be provided, which results in a high installation space requirement, a high weight and high costs of the cylinder head device.

An example of such an element to be supplied with lubricant can be a bearing point at which one of the camshafts is mounted. The element can also be a phase adjustment device, by means of which a phase adjustment of at least one of the camshafts relative to a crankshaft of the internal combustion engine can be carried out.

German patent document DE 10 2008 031 976 A1 disclose such a phase adjustment device in the form of a hydraulically actuatable phase adjustment device, which can be supplied and thereby actuated by the lubricant as the hydraulic fluid. The supply of such a phase adjustment device with lubricant has been shown to be particularly laborious. German patent document DE 697 07 213 T2 also discloses such a phase adjustment device that can only be supplied with lubricant as the hydraulic fluid very laboriously.

Furthermore, a cylinder head of an internal combustion engine having an actuator unit mounted in the cylinder head is disclosed in German patent document DE 10 2011 109 676 A1. The cylinder head has inlet channels and outlet channels. The inlet channels open out at an inlet flange surface and the outlet channels open out at an outlet flange surface. The outlet and inlet flange surfaces are angled with respect to one another such that their line of intersection lies above the cylinder head and the cylinder head therefore has a substantially triangular cross section. The actuator unit comprising at least one actuator is provided in an oil chamber of the cylinder head. The actuator controls and/or regulates the actuating unit for the gas exchange valves.

The element of the cylinder head device to be supplied with lubricant can also be at least one valve play compensation element, by means of which a valve play of at least one of the gas exchange valves can be compensated for. Conventionally, the supply of such a valve play compensation element with the lubricant as hydraulic fluid for actuating the valve play compensation element is very laborious.

Exemplary embodiments of the present invention are therefore directed to a cylinder head device for an internal combustion engine and an internal combustion engine having such a cylinder head device, with which a particularly easy supply of at least one element of the cylinder head device with lubricant can be realized.

In order to create a cylinder head device, in which at least one element can be supplied with lubricant, in particular lubricating oil, in a particularly easy manner, according to the invention, at least one intermediate wall of the cylinder head, by means of which the receiving regions are separated from one another at least in certain areas, is provided between the receiving regions at least in certain areas, wherein at least one duct element, by means of which at least one element of the cylinder head device can be supplied with lubricant, runs in the intermediate wall.

The lubricant can now be fed to the element to be supplied with lubricant via the duct element running in the intermediate wall with only a very low duct length, with only a very small number of parts and therefore particularly cost and weight effectively. In particular, it is possible in a particularly easy matter to divert lubricant from this duct element and, for example, to a first element of the cylinder head device to be supplied with lubricant which is arranged on sides of the first receiving region and to at least one second element of the cylinder head device to be supplied with lubricant which is arranged on sides of the second receiving region.

The duct element in the intermediate wall can therefore constitute a central distribution channel, by means of which the at least one element is to be supplied with lubricant in a simple manner. Further, it is possible to supply the duct element itself with lubricant, in particular lubricating oil, in a particularly easy manner. For this purpose, the duct element is connected, for example, to a lubricant circuit of the internal combustion engine so that the lubricant can easily flow into the duct element.

In a particularly advantageous embodiment of the invention, at least one transfer element formed separately from the cylinder head having at least one channel which is fluidically connected to the duct element, and by means of which the lubricant can be fed to the element, is provided. By means of the transfer element, lubricant can therefore be diverted from the duct element and to the element, i.e., transferred to the element, in a cost-effective and space-saving manner. As a result of this, a supply of the element or of a plurality of elements of the cylinder head to be supplied with lubricant, which particularly satisfies the requirements, is possible, as the lubricant can be diverted from the duct element and fed to the element at least substantially at any point on the duct element and therefore as required. As a result, it is also possible to supply the element with the lubricant with only a very short duct length. This enables the manufacturing effort and the costs of the cylinder head device to be kept low.

The duct element in the intermediate wall is produced, for example, by at least one hole and/or, when the cylinder head is cast, by means of at least one core element. The duct element can, however, also be produced in other ways.

It has been shown to be particularly advantageous when, at least in certain areas, the transfer element encompasses one of the camshafts mounted on the cylinder head, wherein the channel of the transfer element is fluidically connected to at least one second channel running in the camshaft, and wherein the lubricant can be fed to the element by means of the second channel. This enables the lubricant to be fed in a particularly space-saving manner. Further, the lubricant can be fed to the camshaft in the radial direction thereof or to its second channel in a particularly easy manner. Such a radial feeding of the lubricant keeps the axial installation space requirement of the cylinder head device low, as an elaborate axial feeding of the lubricant can be avoided.

In addition, this feeding of the lubricant to the camshaft and into its second channel enables the necessity for a sliding bearing of the camshaft, in order to feed the lubricant to the camshaft in the radial direction via the sliding bearing, to be avoided. Consequently, it is possible to mount the camshaft on the cylinder head by means of an anti-friction bearing mounting and therefore with particularly low friction. As a result, the friction of the cylinder head device and therefore of the internal combustion engine can be kept low, thus enabling the internal combustion engine to be operated with only a low fuel consumption and therefore with low $CO_2$ emissions.

In a particularly advantageous embodiment of the invention, the element to be supplied with lubricant is in the form of a phase adjustment device, which is to be actuated by means of the lubricant and therefore hydraulically, and by means of which a phase adjustment of at least one of the camshafts can be effected in order to set control times of gas exchange valves. Conventionally, the supply of such a phase adjustment device with lubricant is particularly laborious, complex and cost intensive. With the cylinder head device according to the invention, the phase adjustment device can now be supplied in a particularly easy and space-saving manner.

At the same time, it is possible to feed the lubricant to the phase adjustment device via the duct element running in the intermediate wall from the inside, i.e., from a region in the transverse direction of the cylinder head device between the receiving regions, and not from the outside, thus enabling duct lengths for carrying the lubricant to be kept particularly short. As a result, a particularly low manufacturing and assembly effort can be realized for the cylinder head device.

In order to keep duct lengths for feeding the lubricant to the phase adjustment device particularly short, in a further embodiment of the invention, the phase adjustment device can be supplied via the second channel of the camshaft with the lubricant, by means of which the phase adjustment device can be actuated.

In a further, particularly advantageous embodiment of the invention, the element to be supplied with lubricant is in the form of a valve play compensation element, which can be actuated by means of the lubricant and therefore hydraulically, for compensating for a valve play of at least one gas exchange valve. Conventionally, the supply of such a valve play compensation element can also only be realized very laboriously with long duct lengths. With the cylinder head device according to the invention, this problem can be avoided by supplying the valve play compensation element via the duct element running in the intermediate wall.

A further embodiment of the invention, in which, at least in a sub-region, the duct element is in the form of a riser which has a first duct region and a second duct region that is adjacent to the first duct region and fluidically connected to the first duct region, has been shown to be particularly advantageous. Here, with reference to a flow direction of the lubricant, the first duct region extends through the riser (duct element) in the vertical direction of the cylinder head device from bottom to top. Further, the first duct region opens out into the second duct region. With reference to the flow direction of the lubricant, the second duct region extends in the vertical direction of the cylinder head from top to bottom. This embodiment of the duct element as a riser enables air to be removed from the lubricant flowing through the riser in a particularly advantageous manner. The lubricant flowing through the riser first flows upwards in the first duct region, then flows over into the second duct region and back down in the second duct region. When overflowing from the first into the second duct region, any air which is present in the lubricant can collect in an upper region of the riser, escape from the lubricant, and, for example, be discharged.

In a further, advantageous embodiment of the invention, at least one third duct region of the duct element, via which the lubricant can be fed to the valve play compensation element, branches off the second duct region. As the lubricant is fed to the third duct region via the second duct region, the second duct region can act as a collecting space in which a stored volume of lubricant collects, in particular when the internal combustion engine is deactivated. When the internal combustion engine is deactivated, lubricant can flow out of the second duct region, which acts as a collecting space, into the third duct region and further to the valve play compensation element so that the valve play compensation element cannot run empty of lubricant.

A particularly large collecting space for lubricant is provided by the second duct region when the third duct region is arranged in an end region of the second duct region. As a result, the part of the second duct region arranged above the third duct region in the vertical direction of the cylinder head device and of the internal combustion engine can be used as the collecting space. Here, it is particularly advantageous when the second duct region opens out into the third duct region. This enables a particularly large stored volume of lubricant to be realized.

The invention also includes an internal combustion engine for a motor vehicle, in particular a passenger car, having a cylinder head device according to the invention. The ability to supply the at least one element of the cylinder head device with lubricant via the duct element running in the intermediate wall enables the number of supply lines in the cylinder head device and/or in a control housing cover of the internal combustion engine to be kept particularly small. As a result, a particularly low installation space requirement, a particularly low weight and low costs of the internal combustion engine can be realized. Further, lubricant transfer points to the control housing cover as well as lubricant supply holes and lubricant transfer devices can be dispensed with, which benefits the low installation space requirement and the low costs.

Further advantages, characteristics and details of the invention can be seen from the following description of a preferred exemplary embodiment and with reference to the drawing. The characteristics and combinations of characteristics stated above in the description and the characteristics and combinations of characteristics stated below in the description of the figures and/or shown in the figures alone can be used not only in the specified combination in each case, but also in other combinations or in isolation without departing from the scope of the invention.

BRIEF DESCRIPTION OF THE DRAWING FIGURES

The drawings show, in

Figure 2:
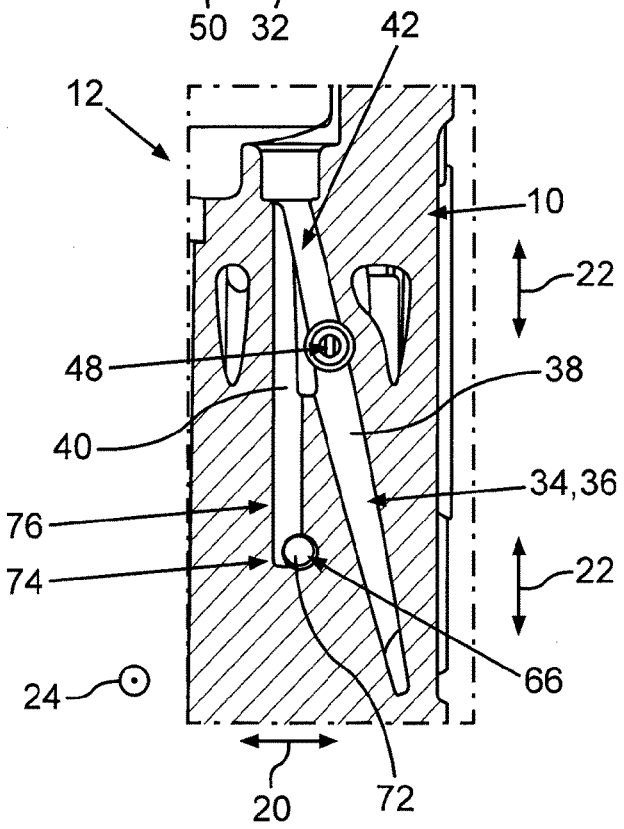
Figure 3:
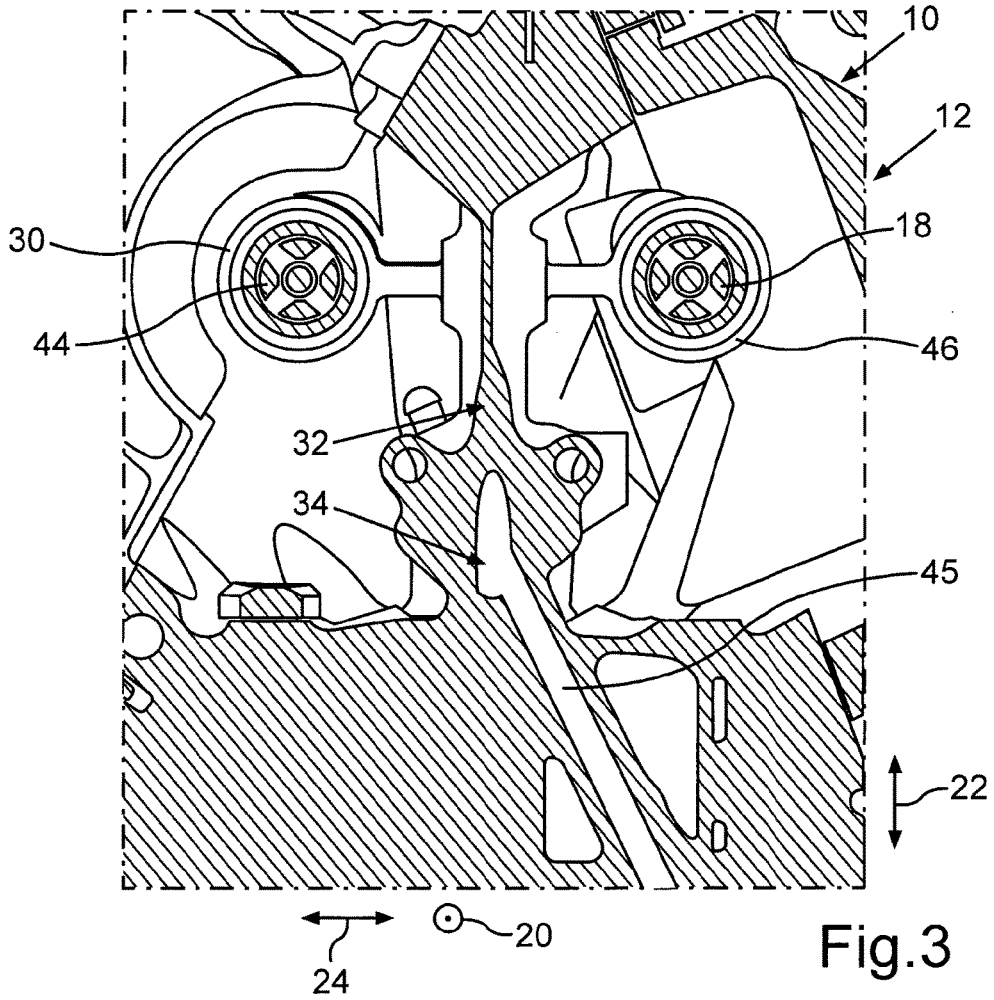
Figure 4:
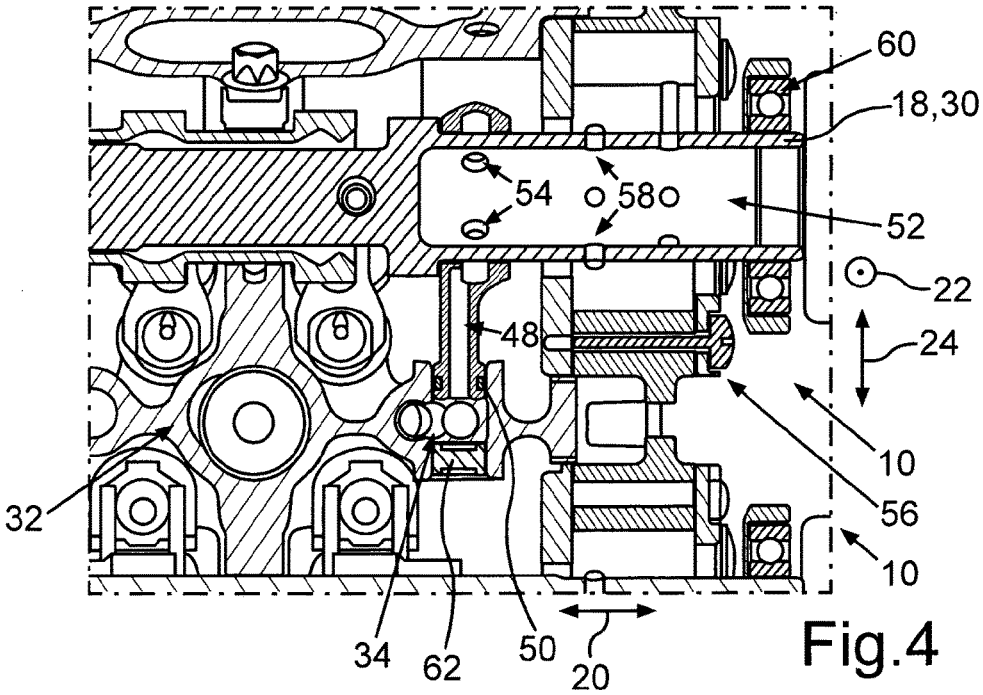
Figure 5:
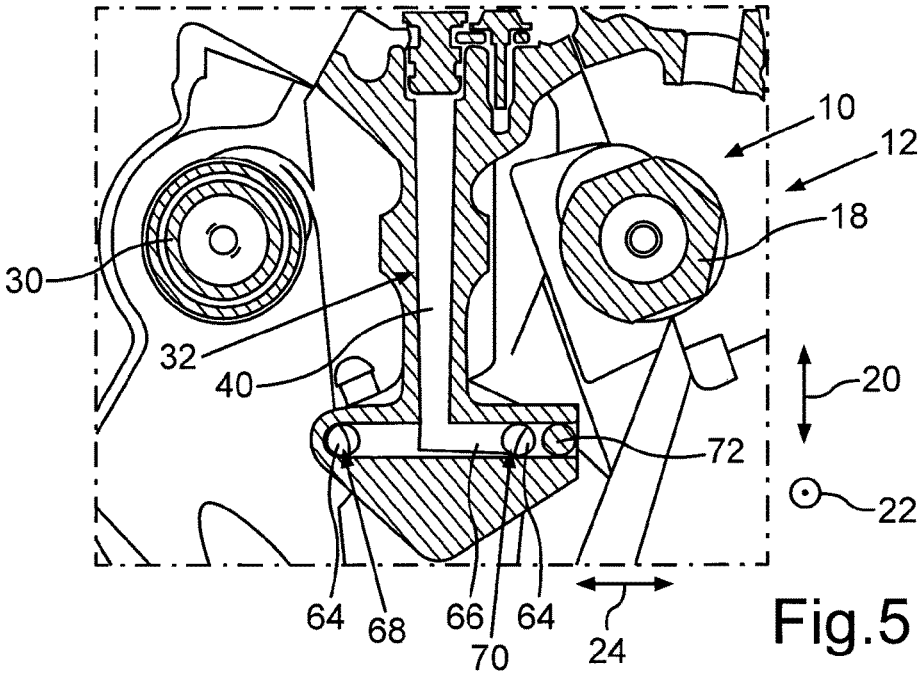

FIG. 1 in section, a schematic side view of a cylinder head of a cylinder head device for an internal combustion engine having two opposing receiving regions for a camshaft in each case, wherein the receiving regions are separated from one another by an intermediate wall, and wherein a duct element, by means of which a plurality of elements of the cylinder head device can be supplied with lubricant, runs in the intermediate wall;

FIG. 2 in section, a schematic longitudinal sectional view of the cylinder head;

FIG. 3 in section, a further schematic sectional view of the cylinder head;

FIG. 4 in section, a schematic longitudinal sectional view of the cylinder head device; and FIG. 5 in section, a further schematic sectional view of the cylinder head device.

DETAILED DESCRIPTION

FIG. 1 shows a cylinder head 10 of a cylinder head device designated as a whole by 12 for an internal combustion engine designed as a reciprocating piston internal combustion engine for a motor vehicle, in particular a passenger car.

The internal combustion engine comprises a cylinder crankcase, which cannot be seen in FIG. 1, with a plurality of combustion chambers in the form of cylinders in which combustion processes take place when the internal combustion engine is running. Here, the cylinder head 10 can be connected or is connected to the cylinder crankcase.

The cylinder head 10 has an inlet side 14, which is also referred to as suction side or intake side. Inlet channels of the cylinder head 10, by means of which a gas, for example air or an air-fuel mixture, can flow into the cylinders, are provided on the inlet side 14. For this purpose, the inlet channels are fluidically connected to the cylinders.

A first receiving region 16 for a first camshaft in the form of an inlet camshaft 18 is also provided on the inlet side 14. Here, the inlet camshaft 18 is arranged in the first receiving region 16 and is rotatably mounted about an axis of rotation, relative to the cylinder head, by means of bearing points on the cylinder head 10 which are provided in the first receiving region 16 and are not visible in FIG. 1. Here, the axis of rotation runs in a longitudinal direction of the cylinder head device 12 indicated by a direction arrow 20, wherein the longitudinal direction of the cylinder head device 12 corresponds to the longitudinal direction of the crankcase and of the whole internal combustion engine. A vertical direction of the cylinder head device 12 and of the internal combustion engine as a whole is indicated by a direction arrow 22. Further, a direction arrow 24 indicates the transverse direction of the cylinder head device 12 and of the internal combustion engine.

The cylinder head 10 also has an outlet side 26 facing away from the inlet side 14 and is customarily also referred to as the exhaust side and lies opposite the inlet side 14. Respective outlet channels of the cylinder head 10, which are fluidically connected to the cylinders and by means of which exhaust gas produced when the engine is running can flow out of the cylinders, are provided on the outlet side 26. Further, a second receiving region 28 for a second camshaft in the form of an outlet camshaft 30 is provided on the outlet side 26. Here, the outlet camshaft 30 is arranged in the second receiving region 28 and is rotatably mounted about an axis of rotation, relative to the cylinder head 10, by means of bearing points on the cylinder head 10 that are provided in the second receiving region 28 and are not visible in FIG. 1. This axis of rotation also runs in the longitudinal direction of the cylinder head 10.

The inlet camshaft 18 serves to actuate gas exchange valves in the form of inlet valves that control the inflow of gas into the cylinders via the inlet channels. Correspondingly, the outlet camshaft 30 serves to control gas exchange valves in the form of outlet valves which control the outflow of the exhaust gas out of the cylinders. The inlet camshaft 18 and the outlet camshaft 30, which are described jointly below as camshafts, are driven by a drive, for example by a belt or chain drive, from a crankshaft of the internal combustion engine.

An intermediate wall in the form of a central web 32 of the cylinder head 10 is arranged in the transverse direction of the cylinder head 10 at least in certain areas between the receiving regions 16, 28, which wall—referred to the transverse direction of the cylinder head 10—is arranged at least substantially in the middle of the cylinder head 10. The receiving regions 16, 28 are separated from one another, at least in certain areas referred to the longitudinal direction, in particular fluidically, by means of the central web 32.

Here, as can be seen from FIG. 1, at least one duct element 34, which is coupled to a lubricant circuit of the internal combustion engine through which a lubricant, in particular lubricating oil, can flow, runs in the central web 32 (intermediate wall). This enables the lubricant to flow through the duct element 34. Here, a plurality of elements of the cylinder head device 12 can be supplied with lubricant by means of the duct element 34.

As can be seen from FIGS. 2 and 3, the duct element 34 is formed at least in a sub-region as a riser 36 and has a first duct region 38 and a second duct region 40 adjacent to the first duct region 38 and fluidically connected to the first duct region 38. At the same time, the first duct region 38 opens out into the second duct region 40. In other words, the second duct region 40 is directly connected to the first duct region 38.

Here, with reference to a flow direction of the lubricant, the first duct region 38 runs through the riser 36 in the vertical direction (direction arrow 22) of the cylinder head 10 from bottom to top so that, as a result, the lubricant is fed from bottom to top by means of the first duct region 36.

Correspondingly, with reference to the flow direction of the lubricant, the second duct region 40 extends through the riser 36 in the vertical direction of the cylinder head 10 from top to bottom so that the lubricant is fed from top to bottom by means of the second duct region 40.

As can be seen from FIG. 2, here, the first duct region 38 runs at an angle to the vertical direction and encloses an acute angle therewith, while the second duct region 40 runs at least substantially in the vertical direction. This embodiment of the riser 36 with the duct regions 38, 40 enables a kind of inverted siphon effect to be realized, as a result of which the lubricant can be bled of any air in the lubricant.

In an upper, in particular uppermost, region 42, in the vertical direction, the lubricant flows from the first duct region 38 to the second duct region 40 so that any air in the lubricant flows upwards in the region 42 and can flow out of the lubricant.

It can be seen from FIG. 3 that the lubricant is fed to the duct element 34 running in the central web 32 via a further riser 45, which feeds the lubricant in the vertical direction from bottom to top to the duct element 34.

Transfer elements 44, 46 of the cylinder head device 12 can also be seen in FIGS. 2 to 4. Here, the transfer elements 44, 46 are formed separately from the cylinder head 10 and—as can be seen particularly in FIGS. 2 and 4—each have a first channel 48 which is fluidically connected to the duct element 34. This enables the lubricant to flow out of the duct element 34 into the first channel 48. In order to avoid an undesirable escape of lubricant between the cylinder head 10 and the transfer elements 44, 46, the transfer elements 44, 46 are in each case sealed by a sealing element 50 against the cylinder head 10.

The transfer elements 44, 46 fully encompass the respective camshafts on their outer circumference in the circumferential direction. In other words, the transfer elements 44, 46 each have a through-opening penetrated by the respective camshafts. As can be seen from FIG. 4, here the camshafts each have a second channel 52 fluidically connected to the first channel 48 of the transfer elements 44, 46 by means of respective through-openings 54 of the appropriate camshaft. This enables the lubricant to flow from the first channel 48 via the through-openings 54 into the second channel 52 and through the second channel 52.

A phase adjustment device 56 as one of the elements that can be supplied with the lubricant can be seen in FIG. 4, wherein the phase adjustment device 56 is actuated by means of the lubricant. Here, control times of the gas exchange valves associated with the appropriate camshaft can be adjusted by means of the phase adjustment device, in that a phase adjustment of the appropriate camshaft is carried out relative to the crankshaft.

The lubricant flowing through the second channel 52 can be fed to the phase adjustment device 56 via further through-openings 58 of the appropriate camshaft (inlet camshaft 18 and/or outlet camshaft 30) and be actuated thereby. The phase adjustment device 56 can therefore be supplied with lubricant via the duct element 34 from within the receiving regions 16, 28, i.e., in the transverse direction of a region between the receiving regions 16, 28, and therefore in a particularly easy, space-saving and cost-effective manner. Further, the lubricant can be fed to the phase adjustment device 56 with only a very short duct length.

In addition, the lubricant can be fed to the phase adjustment device 56 in a radial direction of the camshaft and not in the axial direction, for example. This keeps the axial installation space requirement of the cylinder head device 12 particularly small. Furthermore, a sliding bearing for mounting the respective camshaft on the cylinder head 10 is not required in order to realize this radial feed of the lubricant to the phase adjustment device 56 and for radially feeding the lubricant to the respective camshaft. In other words, the radial feed of the lubricant to the camshaft and to the phase adjustment device 56 in the radial direction can also be realized without sliding bearings. As a result, it is possible to mount the camshafts on the cylinder head 10 with particularly low friction by means of an anti-friction bearing mounting.

Here, an anti-friction bearing 60 of the anti-friction bearing mounting, which, in the present case, is in the form of a ball bearing and by means of which the appropriate camshaft (inlet camshaft 18 and/or outlet camshaft 30) is mounted, can be seen in FIG. 4.

According to FIG. 4, only one of the camshafts is provided with the phase adjustment device 56, so that the duct element 34 in the direction of the other camshaft is fluidically closed by means of a stopper 62. This prevents the lubricant exiting from the duct element 34 in the direction of the other camshaft.

Respective valve play compensation elements 64, by means of which any respective valve play in the particular gas exchange valves can be compensated for, can be seen in section only in FIGS. 2 and 5 as further elements of the cylinder head device 12 which can be supplied with the lubricant. These valve play compensation elements 64 can be actuated by means of the lubricant and therefore hydraulically. The lubricant can also be fed to the valve play compensation elements 64 in a particularly easy manner via the duct element 34. As can be seen in conjunction with FIGS. 2 and 5, a third duct region 66 of the duct element branches from the second duct region 40, wherein the third duct region 66 extends at least substantially in the transverse direction.

In turn, respective ducts 68, 70, which extend at least substantially in the longitudinal direction, extend from the third duct region 66. The lubricant is fed to the valve play compensation elements 64 on the outlet side 26 by means of the duct 68, while the lubricant is fed to the valve play compensation elements 64 on the inlet side 14 by means of the duct 70. The ducts 68, 70 can therefore be connected to the lubricant supply by means of only one channel in the form of the third duct region 66, which, for example, is in the form of a throttle bore, and therefore supplied with lubricant in a particularly easy manner with only a very short duct length. As the third duct region 66 is formed by a bore, for example, this is fluidically blocked on one side with a stopper 72 so that an unwanted escape of lubricant can be prevented.

As can be seen from FIG. 2, the third duct region 66 is arranged in an end region 74 of the second duct region 40. In this case, the second duct region 40 opens out into the third duct region 66, wherein the third duct region 66 is arranged at a lowest point of the second duct region 40 in the vertical direction.

This enables a part 76 of the second duct region 40 that is arranged above the third duct region 66 in the vertical direction to be used as a collecting space for the lubricant. If the activated internal combustion engine is deactivated so that the lubricant is no longer pumped, lubricant can run out of the collecting space to the ducts 68, 70 and via these to the valve play compensation elements 64, so that the valve play compensation elements 64 can be prevented from running empty of lubricant.

An element of the cylinder head device 12 to be supplied with lubricant can also be at least one lubricating point, which, for example, is to be lubricated with the lubricant. In particular here, it can be at least one bearing point, on which the inlet camshaft 18 or the outlet camshaft 30 is mounted on the cylinder head 10. Such a lubricating point or bearing point can also be supplied with lubricant, in particular lubricating oil, in a particularly easy manner by means of the duct element 34 running in the central web 32.

As can be seen from FIG. 1, the cylinder head 10 has a first sealing flange surface 78 arranged on the inlet side 14 and by means of which the cylinder head 10 can be connected to the intake element in the form of an intake module. In the state in which it is connected to the cylinder head 10, the intake module is fluidically connected to the inlet channels so that air from the internal combustion engine sucked into the inlet channels via the intake module can flow into the respective cylinders.

Further, the cylinder head 10 has at least one second sealing flange surface 80 arranged on the outlet side 26 and by means of which the cylinder head 10 can be connected to an exhaust gas element in the form of an exhaust gas module, for example in the form of an exhaust manifold. In the state in which it is connected to the cylinder head 10, the exhaust gas element is fluidically connected to the outlet channels so that the exhaust gas can flow from the cylinder and via the outlet channels into the exhaust gas element and be fed away from the internal combustion engine by means of the exhaust gas element.

A sealing surface for connecting the cylinder head 10 to a cylinder head cover element is now integrated into the respective sealing flange surface 78, 80. This means that the cylinder head cover element can be integrated, for example, into the intake element and/or into the exhaust gas element in the form of a cylinder head cover. In other words, this enables the exhaust gas element and/or the intake element to undertake the function of the cylinder head cover. A separate cylinder head cover can therefore be omitted.

As can be seen from FIG. 1, the sealing flange surfaces 78, 80 extend at an angle to the vertical direction of the cylinder head 10 and run towards one another from bottom to top in the vertical direction. This embodiment of the sealing flange surfaces 78, 80 enables a particularly easy assembly of the intake element and of the exhaust gas element to be achieved. In addition, when viewed from the front, the cylinder head 10 has at least substantially the form of the Greek capital letter delta (A), on account of which the cylinder head 10 is also referred to as a delta cylinder head.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

LIST OF REFERENCES

10 Cylinder head
12 Cylinder head device
14 Inlet side
16 First receiving region
18 Inlet camshaft
20 Direction arrow
22 Direction arrow
24 Direction arrow
26 Outlet side
28 Second receiving region
30 Outlet camshaft
32 Central web
34 Duct element
36 Riser
38 First duct region
40 Second duct region
42 Region
44 Transfer element
45 Further riser
46 Transfer element
48 First channel
50 Sealing element
52 Second channel
54 Through-opening
56 Phase adjustment device
58 Through-opening
60 Anti-friction bearing element
62 Stopper
64 Valve play compensation element
66 Third duct region
68 Duct
70 Duct
72 Stopper
74 End
76 Part
78 Sealing flange surface
80 Sealing flange surface

The invention claimed is:

1. A cylinder head device for an internal combustion engine, the cylinder head device comprising:

a cylinder head comprising at least one first receiving region arranged on an inlet side of the cylinder head on which at least one first camshaft is mounted on the cylinder head, and at least one second receiving region arranged on an outlet side of the cylinder head facing away from the inlet side on which at least one second camshaft is mounted on the cylinder head, wherein the first and second receiving regions are separated from one another at least in certain areas by at least one intermediate wall of the cylinder head, the at least one intermediate wall is arranged at least in certain areas between the receiving regions, wherein at least one duct element, by means of which at least one element of the cylinder head device is supplied with lubricant, runs in the at least one intermediate wall, at least one transfer element formed separately from the cylinder head, the at least one transfer element having at least one channel fluidically connected to the at least one duct element in the at least one intermediate wall of the cylinder head, and by means of which the lubricant is fed to the at least one element;

wherein at least in a sub-region, the at least one duct element is a riser having a first duct region which, with respect to a flow direction of the lubricant, extends through the riser in a vertical direction of the cylinder head device from bottom to top, and a second duct region adjacent to the first duct region and fluidically connected to the first duct region, into which the first duct region opens out and which, with respect to the flow direction of the lubricant, extends in the vertical direction of the cylinder head device from top to bottom;

wherein the first duct region runs at an angle to the vertical direction and encloses an acute angle with the vertical direction and wherein the second duct region runs at least substantially in the vertical direction.

2. The cylinder head device of claim 1, wherein, at least in certain areas, the at least one transfer element encompasses one of the at least one first and second camshafts mounted on the cylinder head, wherein the at least one channel of the transfer element is fluidically connected to at least one second channel running in the one of the at least one first and second camshafts, by means of which the lubricant is fed to the element.

3. The cylinder head device of claim 1, wherein the at least one element supplied with lubricant is a phase adjustment device actuatable by means of the lubricant, and by means of which a phase adjustment of at least one of the at least one first and second camshafts can be effected in order to set control times of gas exchange valves.

4. The cylinder head device of claim 3, wherein the phase adjustment device is supplied via the at least one second channel running in the one of the at least one first and second camshafts with the lubricant, by means of which the phase adjustment device is actuated.

5. The cylinder head device of claim 1, wherein the at least one element supplied with lubricant is a hydraulically actuatable valve play compensation element configured to compensate for a valve play of at least one gas exchange valve.

6. The cylinder head device of claim 1, wherein at least one third duct region of the duct element branches off the second duct region.

7. The cylinder head device of claim 6, wherein the third duct region is arranged in an end region of the second duct region.

8. An internal combustion engine for a motor vehicle, the internal combustion engine comprising:

a plurality of cylinders; and at least one cylinder head device for at least one of the plurality of cylinders, the at least one cylinder head device comprising a cylinder head comprising at least one first receiving region arranged on an inlet side of the cylinder head on which at least one first camshaft is mounted on the cylinder head, and at least one second receiving region arranged on an outlet side of the cylinder head facing away from the inlet side on which at least one second camshaft is mounted on the cylinder head, wherein the first and second receiving regions are separated from one another at least in certain areas by at least one intermediate wall of the cylinder head, the at least one intermediate wall is arranged at least in certain areas between the receiving regions, wherein at least one duct element, by means of which at least one element of the cylinder head device is supplied with lubricant, runs in the at least one intermediate wall, at least one transfer element formed separately from the cylinder head, the at least one transfer element having at least one channel fluidically connected to the at least one duct element in the at least one intermediate wall of the cylinder head, and by means of which the lubricant is fed to the at least one element;

wherein at least in a sub-region, the at least one duct element is a riser having a first duct region which, with respect to a flow direction of the lubricant, extends through the riser in a vertical direction of the cylinder head device from bottom to top, and a second duct region adjacent to the first duct region and fluidically connected to the first duct region, into which the first duct region opens out and which, with respect to the flow direction of the lubricant, extends in the vertical direction of the cylinder head device from top to bottom;

wherein the first duct region runs at an angle to the vertical direction and encloses an acute angle with the vertical direction and wherein the second duct region runs at least substantially in the vertical direction.

* * * * *